US008087369B2

(12) United States Patent
Foce

(10) Patent No.: US 8,087,369 B2
(45) Date of Patent: Jan. 3, 2012

(54) MODULAR SHIP AND FLOATABLE MODULES INTENDED TO BE PART OF THE SHIP

(75) Inventor: Sandro Foce, La Spezia SP (IT)

(73) Assignee: EASTPROJECT S.r.l., La Spezia SP (IT)

( * ) Notice: Subject to any disclaimer, the term of this patent is extended or adjusted under 35 U.S.C. 154(b) by 125 days.

(21) Appl. No.: 12/289,887

(22) Filed: Nov. 6, 2008

(65) Prior Publication Data

US 2010/0107956 A1 May 6, 2010

(51) Int. Cl.
*B63C 7/00* (2006.01)

(52) U.S. Cl. ..... 114/44

(58) Field of Classification Search ..... 114/258–267, 114/44, 45; 405/157, 166, 167
See application file for complete search history.

(56) References Cited

U.S. PATENT DOCUMENTS

| | | | | | |
|---|---|---|---|---|---|
| 2,287,434 | A * | 6/1942 | Knudsen | 114/45 |
| 2,325,607 | A * | 7/1943 | Harris | 114/46 |
| 3,390,532 | A * | 7/1968 | Benton | 405/166 |
| 3,546,888 | A * | 12/1970 | Broussard et al. | 405/166 |
| 3,668,878 | A * | 6/1972 | Jones et al. | 405/167 |
| 3,975,919 | A * | 8/1976 | Harrison | 405/166 |
| 4,120,167 | A * | 10/1978 | Denman et al. | 405/157 |
| 6,688,250 | B2 * | 2/2004 | Davies et al. | 114/264 |
| 7,189,028 | B1 * | 3/2007 | Signaroldi et al. | 405/166 |

* cited by examiner

*Primary Examiner* — Daniel Venne
(74) *Attorney, Agent, or Firm* — Jacobson Holman PLLC

(57) ABSTRACT

A modular ship complex includes a basic vessel provided with water height adjusting elements for varying the height of the waterline with respect to a pool of water forming a housing. The bottom of the housing is formed by a platform that is moved between a raised position and a submerged position by operating the water height adjusting elements to vary the height of the waterline. The ship complex includes equipped floating modules suitable for being inserted into the housing and to be extracted from the housing when the platform is in the submerged position. The modules rest on the platform when the platform is in the raised position. The modules include active operating elements integrated therein.

16 Claims, 7 Drawing Sheets

MODULAR SHIP AND FLOATABLE MODULES INTENDED TO BE PART OF THE SHIP

BACKGROUND OF THE INVENTION

1. Field of the Invention

The present invention relates to a modular ship complex equipped so as to perform operations in a marine environment, such as, for example, laying submerged conduits. The invention relates in particular also to modules that are usable in the ship complex.

2. State of the Prior Art

In the prior art, vessels are known that are equipped with apparatuses that are suitable for laying submerged conduits, such as, for example, pipelines or the like.

The conduit can be of different types and sizes according to the technical specifications that it has to meet, and it can be installed in very deep, deep or medium to shallow waters.

Depending on the cases, various equipment has to be used that is suitable for laying the conduit according to particular laying modes.

For example, the ship can be set up with equipment for the so-called "J-lay" mode, i.e. with the partially submerged conduit positioned on the sea bed according to a J-profile that is almost vertical at the vessel.

The equipment comprises a supporting tower that is suitable for supporting an additional, almost vertical, pipe portion that is welded each time to the end of the partially submerged conduit so as to extend the conduit.

The vessel is provided with tensioning means for tensioning the conduit during the laying down step.

The pipe trunks to be joined to form the conduit are loaded onto the vessel from barges or supply vessels during the operative step, for example by cranes.

Alternatively, the vessel could comprise equipment suitable for laying in "S-lay" mode, i.e. with the partially submerged conduit arranged according to an S-profile whilst the conduit positions itself on the sea bed during laying.

At the stern of the ship there is arranged a structure with an arched profile (called a "stinger" in the relevant jargon) to support the conduit portion that is leaving the ship. The vessel is provided with joining stations that gradually extend the conduit by joining additional trunks of pipe and the free end thereof.

The conduit is maintained taut during laying by means of suitable tensioning apparatuses.

According to other techniques, on the vessel there are installed pipe reels made of stiff steel or reels of flexible pipe that supply portions of conduit during laying. The pipe intended to be laid can be wound on the suitable housings whilst the ship is stationary in port, with an operation that usually requires a certain lapse of time. Also in this case, the equipment intended to extend the pipe comprises suitable tensioning means for tensioning the conduit.

The vessels in question involve a very high investment cost, owing to the considerable size of the vessels and the sophisticated technology used therein (think, for example, of the propellers, the installed power, the dynamic positioning system, or still other things). Therefore, there is very great interest in making the vessel work in the most continuous and productive manner.

Nevertheless, whatever the type of laying equipment integrated in the vessel, the pipe-loading step (in a reel or trunks) requires a considerable outlay of time, which greatly affects productivity, requiring considerable periods stationary in port, to prepare the equipment for the subsequent work.

Further, each vessel has integrated into the structure a different type of equipment for laying the pipe, for example equipment for "J-lay" mode, "S-lay" mode or for laying from pipe reels (also known as "carousels").

For the various types of laying required, a different suitably equipped vessel is necessary. In order to meet in a flexible manner the various needs that may arise in the various practical applications, several variously equipped vessels must be available. Obviously, this situation entails very high investment costs.

The general object of the present invention is to remedy the aforesaid drawbacks by providing a modular ship complex that enables various types of submerged conduit to be laid.

A further object of the invention is to provide a modular ship complex that enables great operating efficiency and flexibility.

A further object of the invention is to provide equipped modules that are suitable for being used in the aforesaid modular ship complex that enable great flexibility to be obtained in the type of submerged pipe laid and enable the efficiency of use of the laying equipment to be increased.

SUMMARY OF THE INVENTION

In view of this object, it has been decided to make, according to the invention, a modular ship complex comprising a vessel capable of varying the height of the waterline thereof. The vessel is provided with a housing, the bottom of which is formed by a platform that can be moved with the vessel between a raised position and a submerged position. The vessel includes means to vary the height of the waterline. The ship complex includes floating modules suitable for being taken into said housing and being extracted from the housing while floating when the platform is in the submerged position. The modules rest on the platform when the platform is in the raised position. The floating modules include operating elements integrated therein.

Still further according to the invention, it has been decided to devise a floating module intended to be inserted into a submergible housing of a vessel with the vessel being capable of varying the waterline. This allows for the carrying of a platform by the vessel. The platform forms the bottom of the housing which is moved by the vessel between a raised position and a submerged position to enable the floating module to be inserted into the housing and the extraction thereof from the housing. There are operating elements on the floating module.

BRIEF DESCRIPTION OF THE DRAWINGS

In order to make the explanation of the innovative principles of the present invention and the advantages thereof over the prior art clearer, with the help of the attached drawings a possible embodiment applying such principles will be disclosed below. In the drawings.

DETAILED DESCRIPTION OF THE PREFERRED EMBODIMENTS

Figure 1:
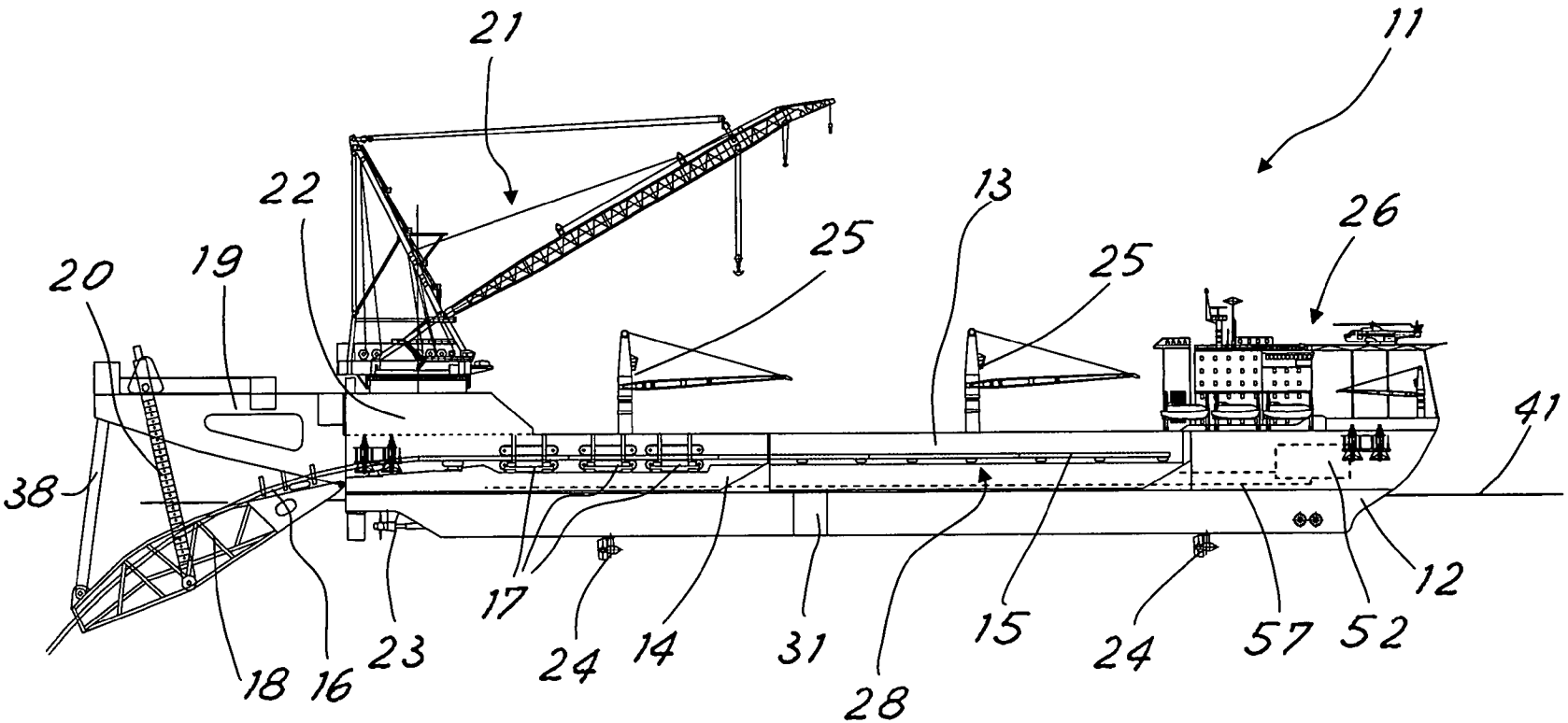
FIG. 1 is a side view of a modular ship complex according to the invention configured for laying a submerged conduit in an "S-lay" mode, where a side bulwark of the vessel has been removed to view the floating modules inserted into a pool of water defined between two opposed bulwarks.

With reference to the figures, in FIG. 1 there is shown a modular ship complex 11 according to the invention.

The complex 11 comprises a vessel 12 and floating modules 13 and 14 having equipment that can be combined with the vessel 12 to perform marine operations.

The vessel 12 is a "dock-carrier" vessel, comprising a submergible housing 37 the bottom of which is formed by a platform 37*a* (clearly indicated in FIG. 2) and equipment for varying the waterline with respect to the vessel so as to take the platform from a raised position to a submerged position and vice versa.

Advantageously, the housing 37 for modules is defined in a pool of water obtained between two side bulwarks of the vessel 12 and the housing provided on one side with a side opening 27, advantageously abaft (toward or at the stern), to enable the module to be inserted and extracted (see FIG. 2) from the housing.

In the raised position of the housing, the module is taken to a dry position and the inserted module rests on the bottom platform 37*a* of the housing above the pool of water.

In FIG. 2, 41-43 indicate various waterlines that the vessel 12 may have, for example the line 43 for the pool so that the platform is in the submerged position and the line 41 for the pool so that the platform is in the raised dry position. The equipment for varying the waterline may comprise a ballast system (not shown in the figure) according to known techniques.

The pool extends longitudinally along the extent of the vessel 12 and may have, for example, a length equal to 200 m, a width equal to 26 m and a height of 13.5 m. On the bottom of the vessel 12 there is a hole 31 (known in the jargon as a "moon pool"), that is rectangular in shape and suitable for being traversed by the conduit during laying in a "J-lay" mode, as will be described below.

The two side bulwarks that bound the pool form side bridges 29 that extend on opposite sides of the vessel. The side bridges 29 are clearly shown in FIG. 3.

In FIG. 1 a side bulwark of the hull has been removed to enable a pair of modules 13 and 14 inserted inside the housing 37 to be viewed. The modules 13 and 14 include equipment for performing marine operations.

The modules 13, 14 being inserted into the housing 37 are positioned by windlasses and supporting hooks and are then immobilized integrally on the vessel 12. Once the modules are received in the housing 37, the vessel 12 is placed in the raised position with respect to the waterline so that the modules 13, 14 rest on the bottom platform 37*a* of the housing.

Figure 2:
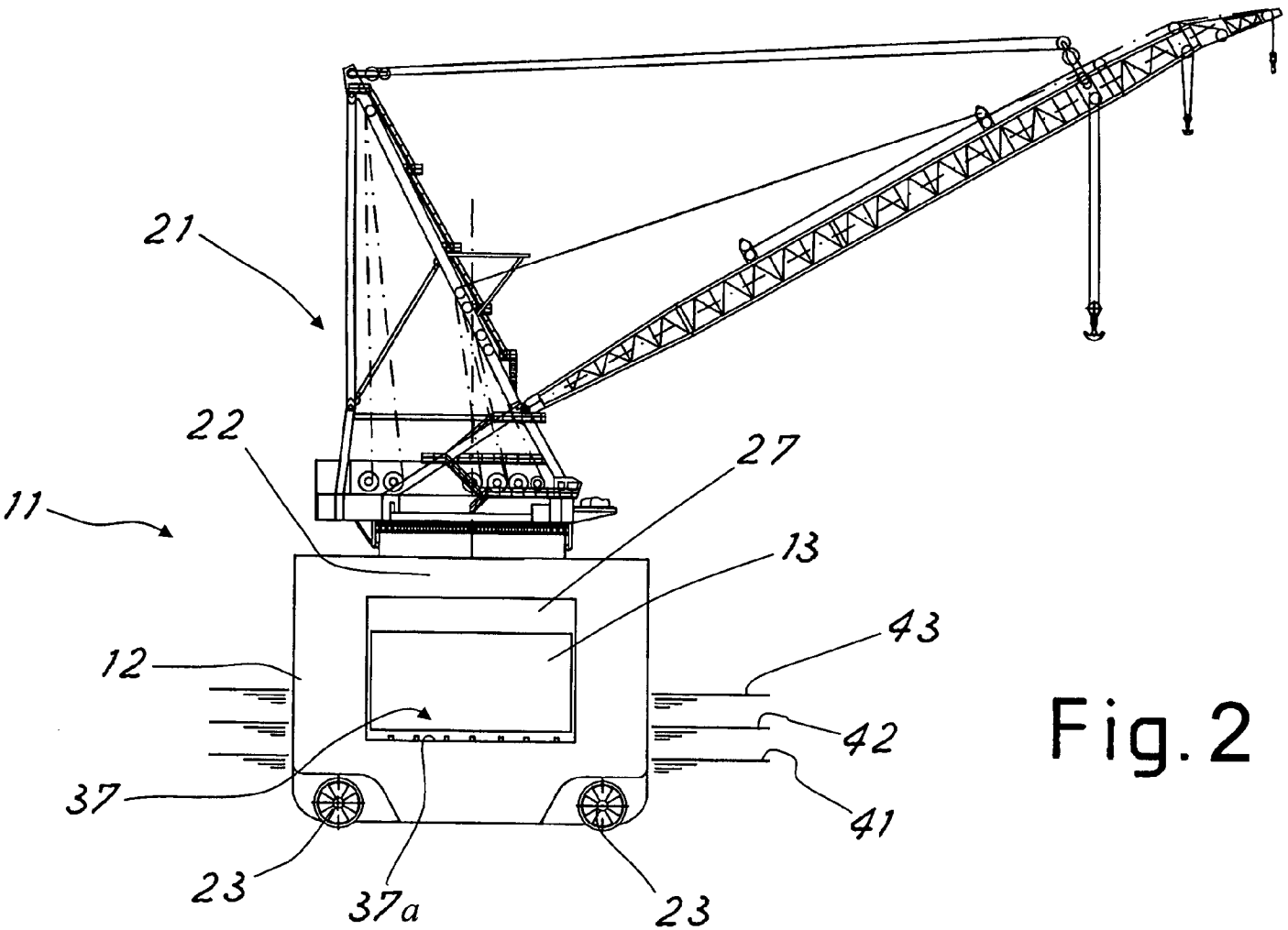
FIG. 2 is a view from the stern of the ship complex of FIG. 1 with the module, that has an arched support for laying in an "S-lay" mode, removed.

In FIG. 2 the module 14 has been removed and the module 13 is shown schematically to show clearly that with the lowermost waterline 41 the modules 13, 14 are placed in the dry position on the platform 37*a* above the level of waterline 41.

In the ship complex, mechanical connecting elements of various type can be provided between the vessel and the modules, to make the module integral with the vessel in the raised position of the platform. Advantageously, engaging the bottom of the module on the bottom (or platform) 37*a* of the housing 37 ensures that the module remains integral with the vessel 12 in any operating condition.

In a preferred embodiment of the invention, the opening 27 is dominated by a bridge 22 that connects the two side bulwarks forming the side bridges 29. The bridge 22 makes a platform on which the screw base of a rotatable crane 21 (known as a "revolving crane") is integrated, advantageously a 3000 T class crane.

The vessel 12 comprises a dynamic positioning system, made according to known techniques with four or more rotatable screw propellers 24. The main propellers 23 of the vessel abaft can also contribute to dynamic positioning.

Towards the bow of the vessel 12 there is a superstructure 26 that contains accommodations such as washrooms, offices, hotels, a hospital, canteens, etc., intended for housing up to 400 people.

On the side bridges 29 some cranes 25 are mounted that are suitable for loading the vessel 12 in port, for example by removing the pipe trunks (or pipe "bars" as they are known in the jargon of the industry) to be laid to extend the submerged conduit during laying.

According to the invention, the modules have operating elements or equipment integrated on the modules that are suitable for conducting marine operations.

In the embodiments shown in the figures the operating elements include equipment for laying submersible conduits, for example pipelines or the like.

Figure 3:
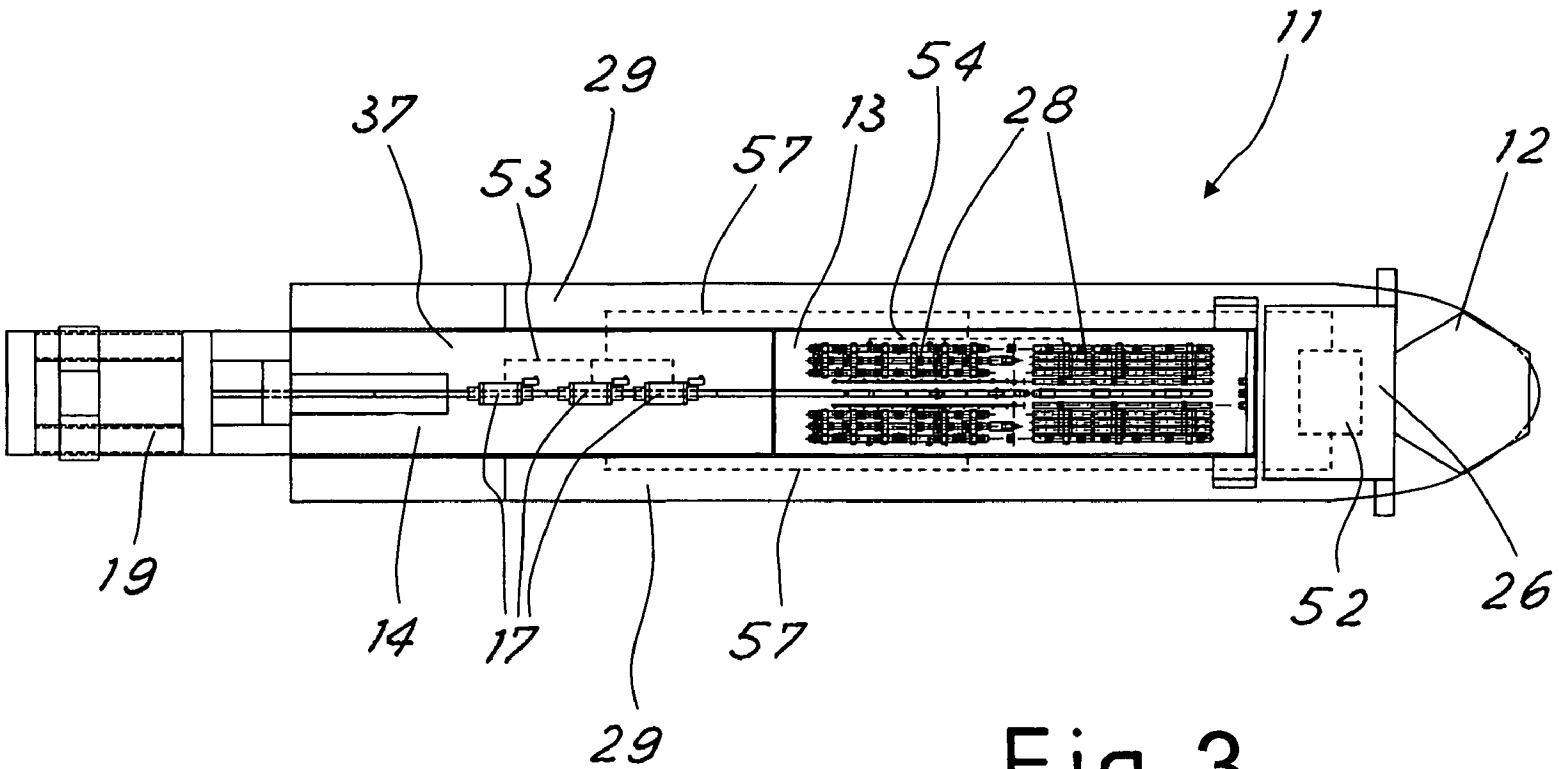
FIG. 3 is a plan view of the complex shown in FIG. 1, with the bridge removed that supports the crane at the stern of the vessel.

The housing 37 can receive two elongated modules arranged in a row, as clearly shown in FIG. 3, where the platform formed by the bridge 22 and the crane 21 was removed to enable the module 13 to be viewed completely.

The modules 13, 14 are equipped for laying a conduit in the "S-lay" mode.

In particular, the module 13 is equipped with joints 28 that are suitable for connecting additional pipe portions 15 to the partially submerged conduit 16 so as to extend the pipe 15 during laying. The joints 28 can be of a multiple joint type.

The station 28 comprises a complete welding-system plant; including joint coating, hydraulic units, electric panels, control panels and other known equipment. In a central position there is arranged the laying line with the so-called "line-up" (for aligning laying of pipes). The joining station 28 is in fact made according to the prior art and will therefore not be disclosed further.

The module 14 comprises known tensioning elements 17 for tensioning the conduit 16 and an arched support 18 (known as a "stinger"), that is suitable in use for supporting the portion of partially submerged conduit 16 that is leaving the ship complex 11, to enable the axial sliding thereof.

The tensioning elements 17 act horizontally and thus also welding of the pipe portions 15 occurs with the pipes arranged horizontally with respect to the joining station 28.

The arched support 18 is supported by a suitable structure 19 integrated on the module 14 and which extends from the stem of the vessel when the module is inserted into the housing 37.

Figure 6:
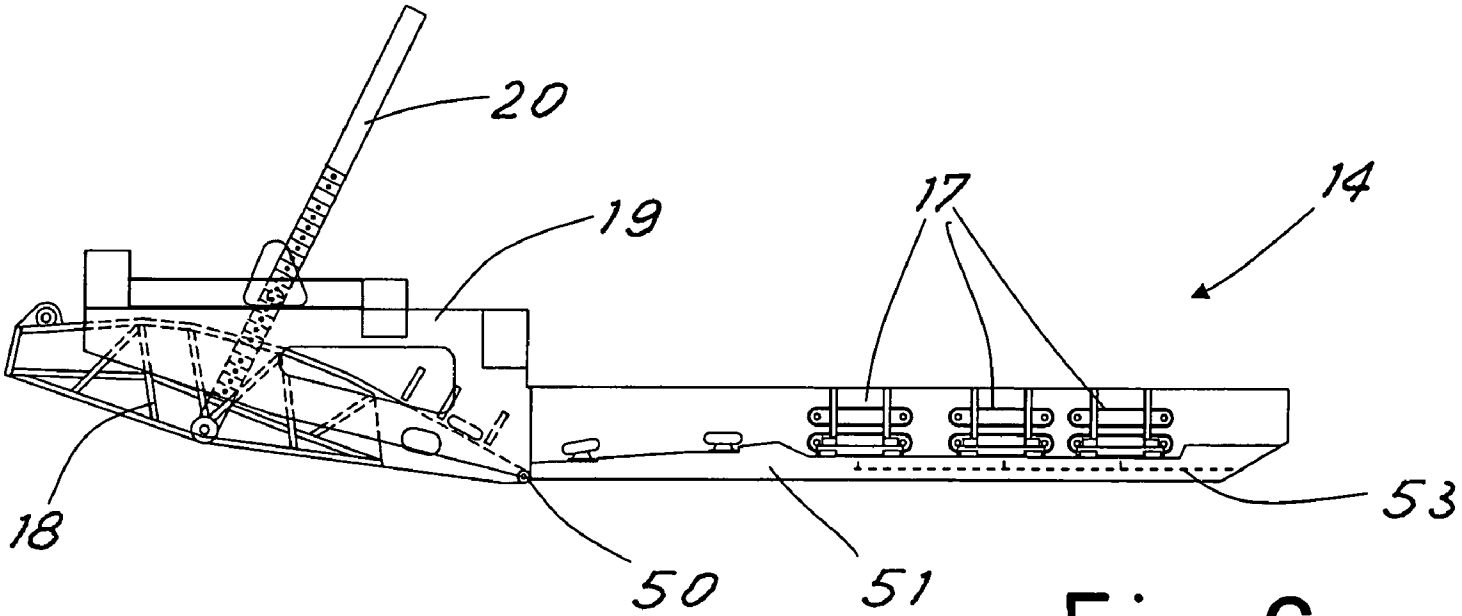
FIG. 6 is a floatable module with equipment for an "S-lay" mode application.

The arched support 18 is movable between a submerged operating position, as in FIG. 1, and a raised non-operating conveying position as shown in FIG. 6, where the module 14 extracted from the housing 37 is shown.

The arched support 18 is hinged with hinging 50 on the body 51 of the module, and can be configured for laying pipe in shallow or deep water.

In the operating configuration, as shown in FIG. 1, the arched support 18 is connected to the supporting structure 19 by a pair of rods 20, 38, according to teachings that are per se known in the prior art.

The cranes 25 can be used to load the pipe trunks to be joined during laying. The large surfaces of the side bridges 29 are used to store the pipe trunks intended to extend the partially submerged conduit during laying. Preferably, the upper bridge of the modules 13, 14 has a height that is the same as that of the side bridges 29 with a module inserted into the pool, so as to have a sole loading bridge with large space for storing the pipes.

The vessel 12 is provided with an electric energy producing unit 52, indicated schematically by a dashed line in FIG. 1. The power installed in the vessel can be equal to several dozen megawatt.

Figure 7:
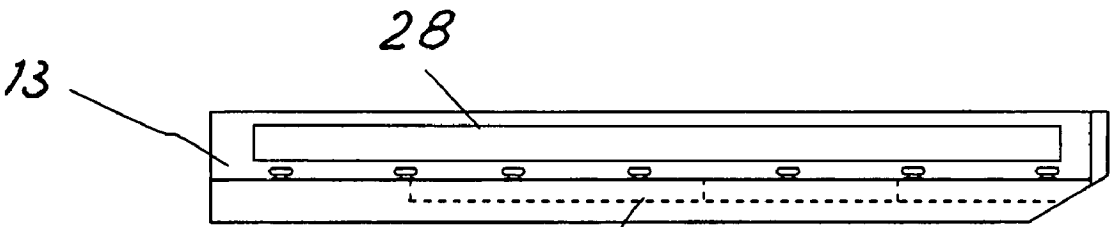
FIG. 7 is a floatable module with equipment for producing a plurality of joints.

The vessel comprises a distribution circuit for distributing energy 57 that can be connected by electric connecting means (not shown in figure) to a supply circuit of the modules that supplies the various items of equipment (operating elements) integrated in the modules. In FIGS. 6-7 there are shown schematically the supply circuits 53 and 54 for the two modules respectively 14 and 13. In FIG. 7 there are shown schematically also the joint 28 intended to make the joint of the pipe portions intended to form the submarine conduit.

Figure 4:
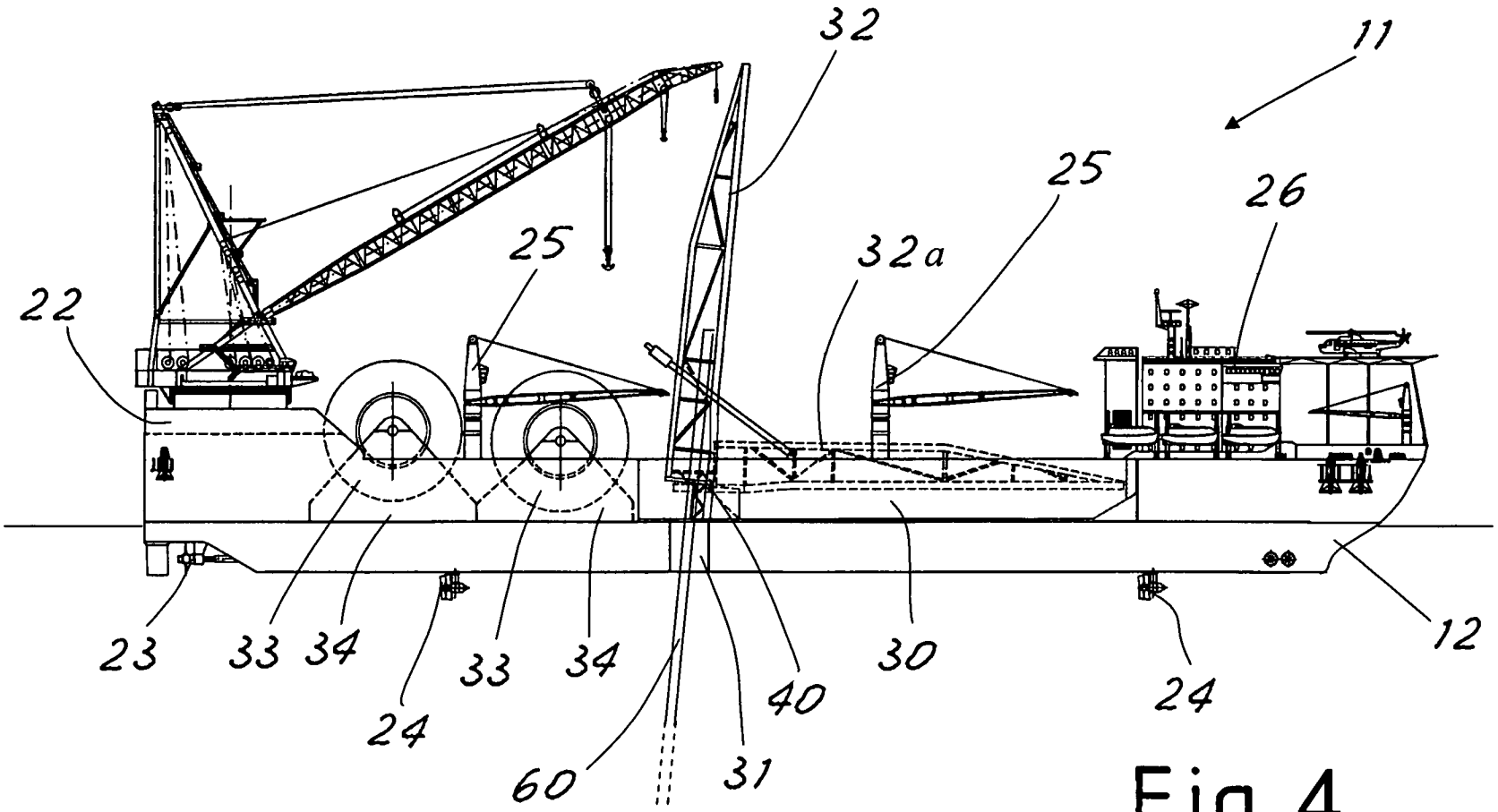
FIG. 4 is a side view of the modular complex configured for laying a submarine conduit in a "J-lay" mode, where a side bulwark of the vessel is removed to enable the modules inserted into the pool of water to be viewed.

In FIG. 4 there is shown a different configuration of the modular ship complex 11 suitable for laying conduit in a "J-lay" mode.

In this case, with the vessel 12 (this is already disclosed with reference to FIG. 1) a different floating module 30 is combined, that is insertable into and extractable from the pool in a similar manner to the modules 13, 14.

The module 30 includes a supporting tower 32 that is suitable in an almost vertical operating position for supporting an almost vertical pipe portion to be joined to the partially submerged conduit 60 arranged with a J profile.

The module 30 is also equipped with double-joint work stations to supply the tower 32 (preferably two stations to the side of the tower, which are not shown in the figures and are per se made according to known techniques).

Figure 8:
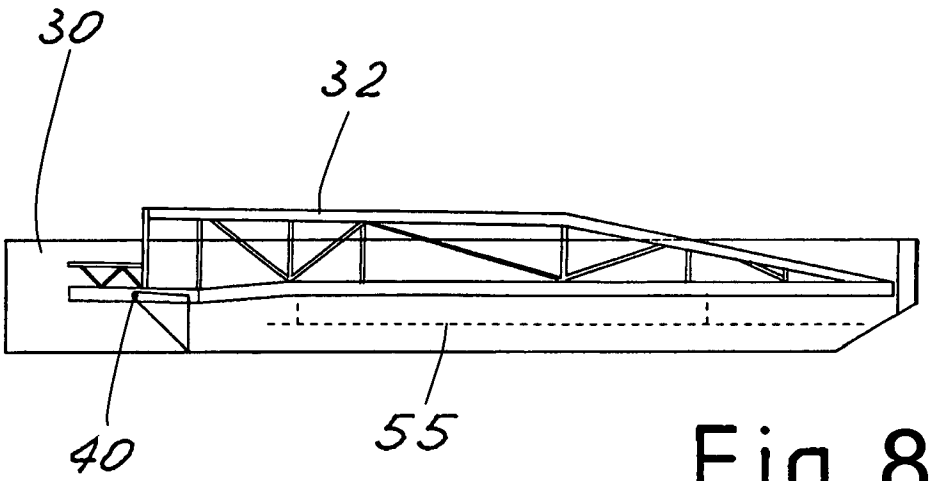
FIG. 8 is a floatable module with equipment for a "J-lay" mode application.

In FIG. 4 a dashed line 32*a* shows the non-operating lowered position of the tower 32 for transferring the module 30, inserting the module 30 and extracting the module 30 into and from the pool. This position of the tower 32, which is almost horizontal, is also shown in FIG. 8.

The tower 32 is hinged with hinging 40 with an axis that is horizontal to the body of the module 30 to be moved between the operating position and the non-operating transferring position. The module is equipped with suitable elements (not shown) to move the tower between the two positions and in order to maintain the tower in an almost vertical operating position during laying in a "J-lay" mode.

Also the module 30 is provided with an electric supply circuit 55 that, in use, is connected to the distribution circuit 57 distributing the energy produced by the unit 52. When the module 30 is inserted into the pool, the base of the tower 32 is arranged above the "moon pool" hole 31, through which the conduit 60 is laid.

In the example shown in FIG. 4 in the pool a single equipped floating module 30 is received, and the remaining space towards the stern can be occupied, for example, with a pair of reels 33 of stiff steel pipe having a diameter in the order of dozens of meters.

The reels 33, with a horizontal axis, are supported by supporting shoulders 34 on opposite sides. They are positioned in the pool using the crane 21, which can lift one reel at a time.

Figure 5:
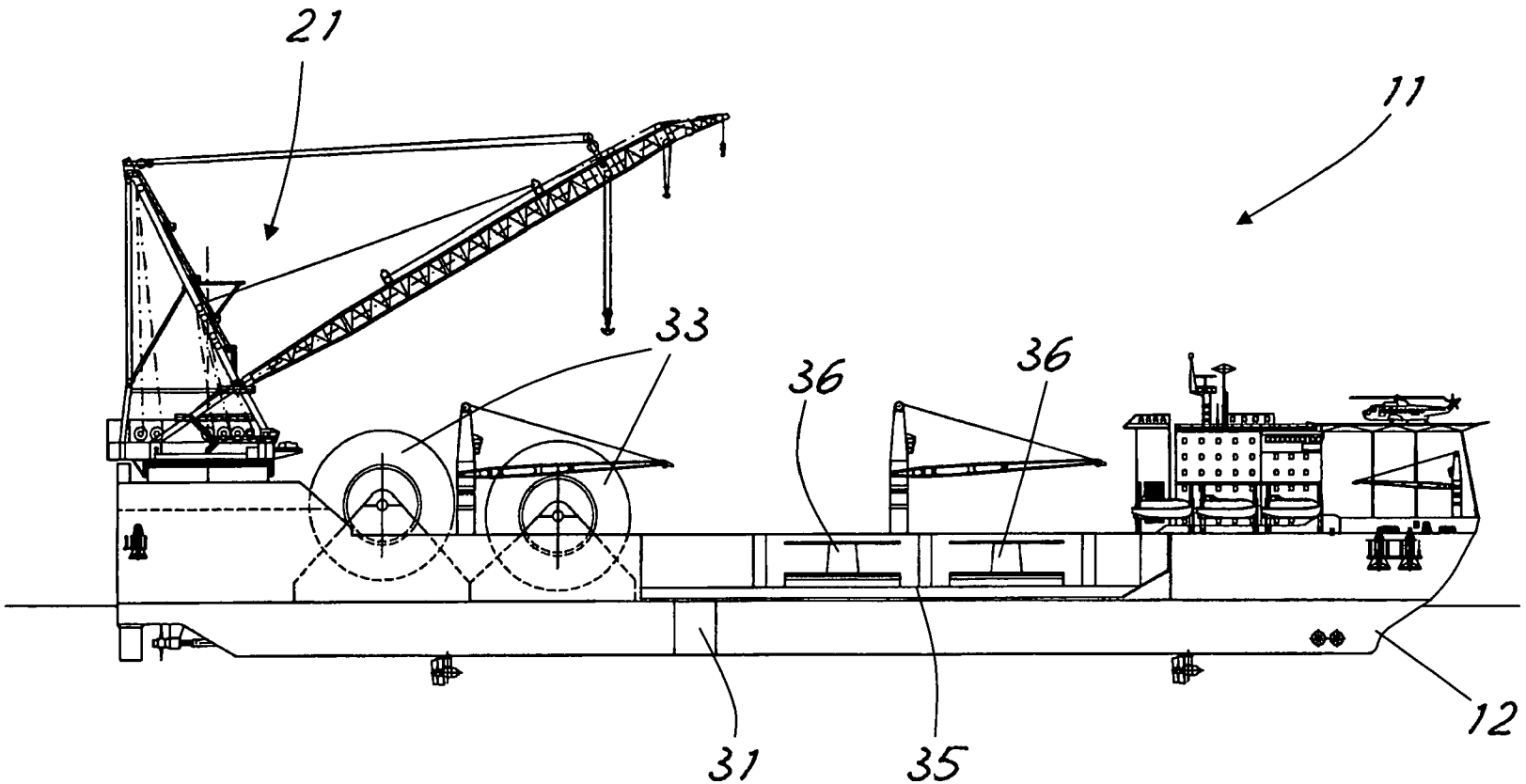
FIG. 5 is a side view of the modular complex configured for laying a submersible flexible conduit, where a side bulwark of the vessel is removed to enable the modules inserted into the pool of water to be viewed.

In FIG. 5 there is shown a third configuration that the modular ship complex 11 can assume, according to which, into the pool of the vessel 12, a floating module 35 that has reels 36 of flexible piping, "carousels", can be inserted.

Two reels 36 are integrated into the module and are arranged with a vertical axis. The pipe wound on the reels is of the flexible type. The diameter of the "carousel" can be equal to approximately 22 m (slightly less than the width of the module and of the pool) and be provided with a corresponding laying ramp, power unit and corresponding control instrumentation. The module can also be used to convey and store pipes in an enclosed manner.

The space that is not occupied by the floating module 35 is usable in various ways, for example by arranging a pair of reels 33 of the type already disclosed previously with reference to FIG. 4.

Figure 9:
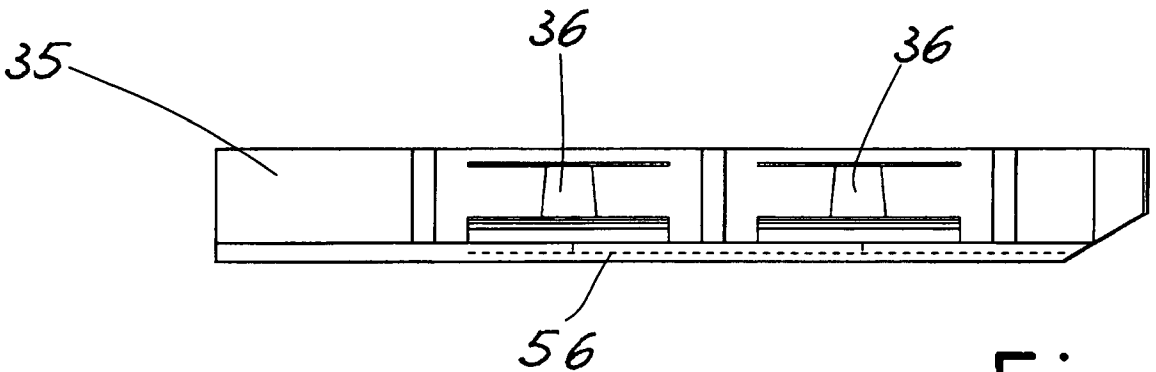
FIG. 9 is a floatable module with equipment for laying conduit from a reel.

In FIG. 9 there is shown the module 35 with the two vertical axis reels 36, one in sequence with respect to the other in relation to the longitudinal direction of the vessel.

The module 35, as in the other cases, is provided with a supply circuit 56 of the equipment suitable for being connected by known connecting elements to the electric distribution circuit of the vessel 12.

There can be different types of umbilical connection enclosed in the side bulwarks of the pool 37, in addition to the electric connectors for supplying the electric circuit of the module, such as piping of various types or other.

All the floating modules 13, 14, 30 and 35 have a width that is slightly less than the width of the pool (for example 0.5 m per side for the fender bars) and can be rapidly inserted or removed during floating when the pool is in a submerged state.

This enables the type of laying equipment of the submersible conduit to be changed without having to have different vessels with integrated equipment available, as occurred with the prior art.

In this manner, the modular ship complex enables very great operating flexibility to be achieved, thus enabling laying with different conduit laying modes, depending on need, simply by changing the module having equipment for performing marine operations (or the modules) inserted into the pool.

Further, the naval complex can be used in a very efficient manner, thus minimizing the time in port.

For example, if a module with "carousel" reels is used, the time required for supplying the vessel with flexible pipe is considerably less than that which would have been necessary to load the reel integral with the vessel according to the prior art. In fact, the module that has the reels can be stationary in port to be loaded with the wound pipe whilst the ship complex is operating with other modules. Once the reel has been loaded it is sufficient to insert the floating module into the pool, without having to spend time with the vessel stationary in port with the reel being loaded.

At this point it is clear how the objects of the present invention have been reached.

A modular ship complex has in fact been provided that enables very great flexibility to be obtained in the choice of laying modes and satisfactory productivity to be obtained with the time in port being minimized.

Naturally, the above description of an embodiment applying the innovative principles of the present invention is provided merely by way of example of such principles and must not therefore be taken to limit the scope of what is claimed herein.

For example, the side opening 27 of the pool could also not be dominated by a bridge 22 like the one shown in the figures and the crane 21 could also be absent. The vessel can be provided with prior-art ice-breaking devices.

As an alternative, the floating module can be equipped with operating elements which include devices for drilling a bore underwater.

What is claimed is:

1. Modular ship complex comprising a vessel, a height of the vessel above a waterline being variable, a housing contained in the vessel, a bottom of the housing being a platform, the waterline being varied with respect to the vessel so that the platform is in one of a raised position and a submerged position, and floatable modules inserted into said housing and extracted from the housing when the platform is in the submerged position, and the floatable modules resting on the platform when the platform is in the raised position through elevation of the vessel with respect to the waterline, the floatable modules including pipe laying equipment for laying a submerged conduit or drilling equipment for drilling a bore underwater.

2. Modular ship complex according to claim 1, further comprising an opening in the vessel to enable the floatable modules to be inserted and extracted from the housing.

3. Modular ship complex according to claim 2, wherein the opening is arranged at a stern of the vessel.

4. Modular ship complex according to claim 2, wherein the opening is in the vessel between two side bulwarks of the vessel.

5. Modular ship complex according to claim 4, wherein the floatable modules have a width that is slightly less than a space between the two side bulwarks.

6. Modular ship complex according to claim 3, wherein the opening is covered by a bridge on which there is mounted a crane.

7. Modular ship complex according to claim 1, wherein said pipe-laying equipment includes a joining station for joining pipe portions intended for extending a partially submerged conduit.

8. Modular ship complex according to claim 1, wherein the vessel includes a tensioning element that is partially submerged during pipe-laying.

9. Modular ship complex according to claim 1, wherein said vessel includes a supporting tower for joining a conduit that is partially submerged during pipe-laying.

10. Modular ship complex according to claim 9, wherein said tower is arranged near a hole in the platform when the floatable module is inserted into the housing, the hole is traversed by the conduit that is partially submerged during pipe-laying.

11. Modular ship complex according to claim 1, wherein the vessel includes an arched support of the pipe for use when the floatable module is inserted into the housing at an end of the vessel to support an end portion of a partially submerged conduit.

12. Modular ship complex according to claim 11, wherein the arched support is mounted movably on the floatable module to move between a raised non-operating position and a submerged operating position.

13. Modular ship complex according to claim 1, wherein said pipe-laying equipment including reels of flexible pipe.

14. Modular ship complex according to claim 13, wherein the reels are mounted on the floatable module and have a vertical rotation axis.

15. Modular ship complex according to claim 1, further comprising an electric-energy producing unit and a distribution circuit for distributing energy produced by the electric-energy generating unit.

16. Modular ship complex according to claim 1, further comprising a propeller for dynamic positioning of the vessel.

* * * * *